US005087393A

United States Patent [19]

Guest et al.

[11] Patent Number: 5,087,393

[45] Date of Patent: Feb. 11, 1992

[54] SMOKE PRODUCING ARTICLE

[75] Inventors: Martin J. Guest, Ramsgate; Richard E. Topping, Tunbridge; Roderick J. McGregor, Lincoln, all of England

[73] Assignee: Astra Holdings Public Limited Company, Canterbury, England

[21] Appl. No.: 431,593

[22] Filed: Aug. 31, 1989

[30] Foreign Application Priority Data

Sep. 1, 1988 [GB] United Kingdom ..... 8820660

[51] Int. Cl.[5] ..... C06B 21/00

[52] U.S. Cl. ..... 264/3.2; 264/3.3

[58] Field of Search ..... 264/3.1, 3.2, 3.3

[56] References Cited

U.S. PATENT DOCUMENTS 4,015,355 4/1977 Schiessl et al. ..... 102/90 X
4,210,555 7/1980 Lubbers et al. ..... 102/90 X
4,503,004 3/1985 Mirabella ..... 102/334
4,534,810 8/1985 Knapp ..... 149/19.6
4,682,544 7/1987 Koroscil et al. ..... 102/336
4,841,865 6/1989 Liberman ..... 102/334
4,968,365 11/1990 Krome ..... 149/41

*Primary Examiner*—Peter A. Nelson
*Attorney, Agent, or Firm*—Oblon, Spivak, McClellan, Maier and Neustadt

[57] ABSTRACT

A smoke producing article comprises preformed granules of a smoke generating material admixed with an inert binder. The granules are compressed at such a pressure and for such a period of time that the granules deform to take up a reduced volume overall but remain separable discrete particles. The smoke generating material is advantageously red phosphorus. The compression is at 2–7 tons/sq. inch (31–110 MPa), and the compression time is 3–10 seconds.

5 Claims, 1 Drawing Sheet

SMOKE PRODUCING ARTICLE

Figure 1:
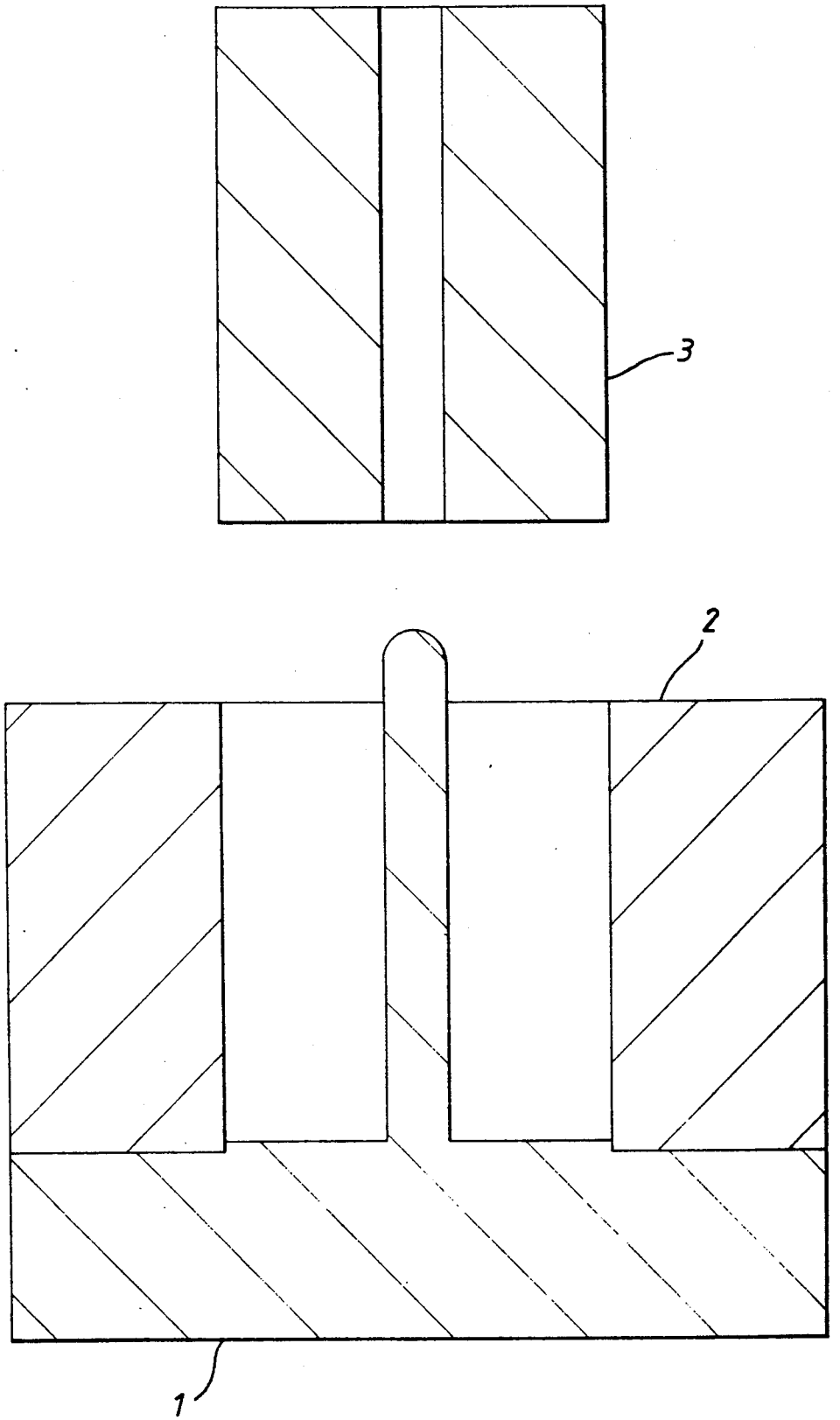

The present invention relates to a smoke producing article. More particularly, but not exclusively, it relates to a pressed "brick" of smoke generating composition and a method and apparatus of making it.

Smoke generating compositions are used particularly in military applications for providing an immediate and effective smokescreen for infantry, artillery, vehicles or ships, the purpose being to prevent the enemy, whether real or, in training, imaginary, from seeing what those units are doing.

One well known smoke generating material is phosphorus and the present invention will be described with reference to this element. It is of course not limited to such an element. White phosphorus may be used for generating smoke, but its volatile physical characteristics render it difficult to use. Red phosphorus has improved safety, application and general handling qualities but nevertheless use thereof does present several problems. Amorphous red phosphorus cannot easily by itself be used to form any solid article but must be encased or otherwise encapsulated Furthermore, during manufacture of smoke producing articles using amorphous pure red phosphorus, there is the risk of ignition through friction, and the risk of the evolution of dust, which may spread resulting in contamination of surrounding areas. When used in a substantially pure form, red phosphorus has accidental ignition characteristics, and can therefore be dangerous.

There has been developed a product comprising granules of composed red phosphorus admixed with an inert binder material. One form commercially available comprises a mixture of approximately 70–75 wt % stabilised red phosphorus, and 25–30 wt % of a binder which may be a polymeric wax type material, with volatile matter 0.5 wt % (maximum). The bulk density of the granules is 0.8 and the specific gravity is approx. 1.6. Thus the red phosphorus is effectively desensitised against accidental ignition and the mixture is a much more convenient material to handle. The mixture is extruded as a rod of predetermined diameter and the rod is chopped into predetermined lengths to form the granules.

However, these granules, by which is meant particles of any convenient size, are still not easy to use when their primary function is to produce a smokescreen. The granules pack loosely together reducing the effective mass of smoke producing material for a given available volume, and again need to be contained within an enclosure which may adversely affect the ignition characteristics of the smoke producing article.

It is an object of the present invention to provide a smoke producing article which overcomes the above disadvantages and enables such an article to be produced which is more compact and more effective.

According to a first aspect of the present invention there is provided a smoke producing article comprising granules, as hereinbefore defined, of composed a smoke generating material admixed with an inert binder, said granules being compressed at such a pressure and for such a period of time that the granules deform to take up a reduced volume overall but remain separable discrete particles.

Preferably, the smoke generating material comprises phosphorus, advantageously red phosphorus.

The compression may be at 2–7 tons/sq. inch (31–110 MPa), optionally 3.5–4.5 tons/sq. inch (54–70 MPa).

The preferred compression dwell time is 3–10 seconds, advantageously 5 seconds.

The article is preferably a cylindrical annulus, having a central hole adapted optionally to receive an igniferous pyrotechnic composition adapted to separate and disperse the particles and initiate burning of each of them on deflagration.

According to a second aspect of the present invention there is provided a method of making a smoke producing article comprising the steps of providing discrete granules of composed a smoke generating material admixed with an inert binder, compressing said granules at such a pressure and for such a period of time that the granules deform to remain discrete but take up a reduced overall volume.

Preferably, the smoke generating material is phosphorus, advantageously red phosphorus.

The compression may be at 2–7 tons/sq. inch (31–110 MPa), optionally 3.5 to 4.5 tons/sq. inch (54–70 MPa).

The preferred compression dwell time is 3–10 seconds, advantageously 5 seconds.

The compression is preferably such that the article forms a "brick" which is sufficiently strong to withstand general handling and moderate forces, but in which the discrete granules can easily be separated substantially completely and dispersed by the percussive force of ignition of an igniferous pyrotechnic composition.

According to a third aspect of the present invention there is provided a press tool for producing smoke producing article according to a first aspect of the present invention, and by a method according to a second aspect of the present invention.

According to a fourth aspect of the present invention there is provided a smoke producing article comprising a bursting charge surrounded by a compressed block of granules of a mixture of a phosphorus composition and binder.

An embodiment of the present invention will now be more particularly described by way of example and with reference to the accompanying drawing, in which the single FIGURE shows schematically a press tool used in the method of the present invention.

The tool comprises an integral base and central former 1, a sleeve 2, and a drift 3 which contains a central hole dimensioned to accommodate the central former of the base 1.

In order to prepare an article embodying the invention, the sleeve 2 is positioned on the base 1 and the annular space thus formed is filled to a predetermined degree with granules of a composition comprising red phosphorus and an inert binder such as a waxy polymeric material. The drift 3 is then positioned over the central former of base 1 and a load of approx. 4 tons/sq. inch (62 MPa) is applied for a dwell time of 5 seconds.

The tool can then be dismantled and a cylindrical annular "brick" of granulated red phosphorus may be removed. The brick will maintain its integral shape, subject to a 5% relief after removal of the pressure, and each of the granules is still visibly discrete but the totality thereof will have taken up all the available volume. The brick will withstand general handling and moderate forces.

In order to use the article, an igniferous and explosive pyrotechnic composition is placed in the central aperture of the annulus, optionally within a plastics tube.

The percussive effect of explosion of the charge will break down the brick substantially completely into its constituent granule parts. These will be distributed radially, and evenly, over a wide area. Each granule is, of course, ignited by the pyrotechnic event and will burn to generate smoke for a discrete time dependent on the size and shape of the granule or the amount of red phosphorus contained therein.

Since the burning progresses evenly from each surface of the granule, the diameter (or length if less than the diameter) will determine the length of time for which smoke is produced, while the volume of the granule will determine the overall amount of smoke produced by the granule.

If desired, a mixture of granule sizes may be combined in a single smoke producing article. Examples of burn times for different size granules are approx. 30 seconds for a granule 3 mm × 6 mm — approx. 1 minute for a granule 6 mm×6 mm — and approx. 2 minutes for a granule 10 mm×8 mm.

The granules are generally formed by extrusion of a mixture of approximately 70 wt % stabilised red phosphorus, 30% waxy polymeric binder, preferably a polyester wax. However the exact proportions are not crucial, provided that there is sufficient phosphorus to generate enough smoke and sufficient binder to hold the granule together and desensitise the phosphorus against accidental ignition. Similarly, alternative smoke producing materials may be used, or mixtures of materials adapted to give particular effects may be employed The polymeric wax has a melting point in the region of 70° C., although higher melting point polymers may in fact be preferable.

One important facet of the present invention is that the granules remain discrete, even though compressed to take up a minimum acceptable volume. For example, the compacted mass may be 1.5 times the density of the uncompacted mass. Each granule separates in the explosion. Other attempts to compress such granules have destroyed the integrity of the granules and, on deflagration of such devices, there is a random array of particle sizes. This can lead to substantial pockets of smoke being produced as the larger lumps or groups or granules slowly burn to extinction after the main smoke screening effect has gone. This can be wasteful of the phosphorus or other smoke generating material. It can also cause problems in that the initial smoke screen produced is not sufficiently thick, only generating its full screening effect as the larger particles burn.

The present invention allows even distribution of the smoke generating material to give an optimum screen for the amount of material used, the granules being consumed substantially uniformly, if that is the desired effect.

The granule size may be adjusted to give a desired density of smokescreen, or a smokescreen of substantially predetermined time duration. Furthermore, the "brick" of compressed granules may incorporate granules of different, predetermined, sizes, possibly in a predetermined arrangement, to give a smokescreen of optimum density and duration.

The smoke producing article may be incorporated into any of a number of articles — for example: a hand throwable smoke grenade; a vehicle discharge grenade; a smoke mortar bomb; an artillery round; a bomb, especially a cluster bomb; or an infra-red emitting decoy.

We claim:

1. A method of making a smoke producing article comprising the steps of:

mixing red phosphorus with a polymeric wax binder;

extruding the product of said mixing step to form an elongate product of predetermined diameter;

chopping the product of said extruding step into predetermined lengths to form granules;

placing said granules within a press tool;

compressing said granules within said press tool at a pressure of 2–7 tons/sq. in. (31–110 MPa) until said granules deform to take-up a reduced overall volume;

continuing said compression only until said compressed granules form a block but said granules remain discrete and separable substantially completely from said block; and removing said block from said press tool.

2. A method according to claim 1, wherein the initial step comprises mixing 70–75 wt% red phosphorus with 30–35 wt% polymeric wax binder.

3. A method according to claim 1, wherein the compressing step comprises compressing the granules at a pressure of 3.5 to 4.5 tons/sq. inch (54–70 MPa) for a period of 3–10 seconds.

4. A method according to claim 1, wherein the press tool is annular and the block formed is annular.

5. A method according to claim 4, further including the step of inserting a bursting charge into the central hole of said annular block, whereby detonation of said bursting charge will separate, distribute, and ignite the discrete granules.

* * * * *